US011022025B1

(12) United States Patent
Lee

(10) Patent No.: US 11,022,025 B1
(45) Date of Patent: Jun. 1, 2021

(54) APPARATUS FOR CONTROLLING ENGINE AND METHOD THEREOF

(71) Applicants: Hyundai Motor Company, Seoul (KR); Kia Motors Corporation, Seoul (KR)

(72) Inventor: Su Ho Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/902,943

(22) Filed: Jun. 16, 2020

(30) Foreign Application Priority Data

Feb. 4, 2020 (KR) ..... 10-2020-0013059

(51) Int. Cl.

| | |
|---|---|
| ***F01P 7/14*** | (2006.01) |
| ***F01P 3/18*** | (2006.01) |
| ***F01P 7/16*** | (2006.01) |
| ***F01P 11/18*** | (2006.01) |
| *F01P 3/02* | (2006.01) |

(52) U.S. Cl.
CPC ..... *F01P 7/167* (2013.01); *F01P 3/18* (2013.01); *F01P 11/18* (2013.01); *F01P 3/02* (2013.01); *F01P 2003/024* (2013.01); *F01P 2007/146* (2013.01); *F01P 2025/04* (2013.01); *F01P 2025/64* (2013.01)

(58) Field of Classification Search
CPC ..... F01P 2007/146; F01P 2025/04; F01P 2037/00; F01P 7/026; F01P 7/14
See application file for complete search history.

(56) References Cited

U.S. PATENT DOCUMENTS

| | | | | |
|---|---|---|---|---|
| 7,168,397 | B2 * | 1/2007 | Chanfreau | B60H 1/00485 123/41.01 |
| 10,294,852 | B2 | 5/2019 | Lee et al. | |
| 2002/0195067 | A1 * | 12/2002 | Murakami | F01P 3/20 123/41.1 |
| 2013/0047940 | A1 * | 2/2013 | Quix | F01P 7/165 123/41.08 |
| 2013/0221116 | A1 * | 8/2013 | Tsuchiya | G05D 23/134 236/34.5 |
| 2014/0007824 | A1 * | 1/2014 | Hayashi | F01P 7/167 123/41.01 |
| 2015/0144078 | A1 * | 5/2015 | Hutchins | F01P 7/16 123/41.1 |

(Continued)

FOREIGN PATENT DOCUMENTS

| | | | |
|---|---|---|---|
| KR | 1020170024380 | A | 3/2017 |
| KR | 1020190046337 | A | 5/2019 |

*Primary Examiner* — Long T Tran
(74) *Attorney, Agent, or Firm* — Mintz Levin Cohn Ferris Glovsky and Popeo, P.C.; Peter F. Corless

(57) ABSTRACT

An apparatus for controlling an engine and a method thereof are provided. The apparatus includes an integrated thermal management (ITM) that adjusts opening of a plurality of valves as a cam rotates and a storage that stores a table for differential pressure between a front end and a rear end of each of the plurality of valves, based on an engine revolution per minute (RPM) and an ITM angle. A controller determines a state of the ITM and adjusts opening degrees of the plurality of valves depending on the differential pressure of the valve, based on the differential pressure table based on the state of the ITM.

19 Claims, 5 Drawing Sheets

(56) References Cited

U.S. PATENT DOCUMENTS

| | | | | |
|---|---|---|---|---|
| 2015/0176472 | A1* | 6/2015 | Hutchins | F01P 7/165<br>701/102 |
| 2017/0335750 | A1* | 11/2017 | Yumisashi | F16K 5/06 |
| 2019/0128173 | A1 | 5/2019 | Lee et al. | |
| 2019/0186337 | A1* | 6/2019 | Insixiengmai | F01P 3/20 |

* cited by examiner

APPARATUS FOR CONTROLLING ENGINE AND METHOD THEREOF

CROSS-REFERENCE TO RELATED APPLICATION

This application claims the benefit of priority to Korean Patent Application No. 10-2020-0013059, filed on Feb. 4, 2020, the entire contents of which are incorporated herein by reference.

TECHNICAL FIELD

The present disclosure relates to an apparatus for controlling an engine of a vehicle and a method thereof, and more particularly to a technology of controlling flow rate distribution of a coolant of a gasoline engine.

BACKGROUND

Recently, studies and researches on vehicles have been conducted in the development of next-generation engines and transmissions while focusing on three key challenges such as high fuel efficiency, practical performance, and eco-friendliness. Accordingly, applying of technologies regarding a gasoline engine and a transmission and developing of parts of the gasoline engine and the transmission have been actively discussed in various manners. For example, a technology has been attempted to be developed for combining the engine and the transmission to provide the fuel efficiency improved to about 10% or more compared to a conventional gasoline engine and thus to satisfy the needs of customers, and having competiveness in terms of performance and durability.

The development of such a vehicle engine corresponds to further fuel-efficiency and environment regulations and satisfies various demands for vehicle performance of drivers to actually improve the fuel efficiency, to improve practical performance, and to reduce exhaust gas. Accordingly, research has been conducted regarding various technologies of controlling or adjusting a coolant temperature to distribute a coolant into an engine radiator, a transmission oil warmer, and a heater provided in an integrated thermal management (ITM) inside an engine, and detailed techniques are required to improve the fuel efficiency through the technologies.

SUMMARY

The present disclosure provides an apparatus for controlling or operating an engine of a vehicle, capable of determining differential pressure between a front end and a rear end of an ITM using a revolution per minute (RPM) and an ITM angle and of adjusting flow rate distribution of a coolant based on the differential pressure, when controlling the ITM to be opened, and a method thereof.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an apparatus for controlling an engine may include an integrated thermal management (ITM) configured to adjust opening of a plurality of valves as a cam rotates, a storage configured to store a table for differential pressure between a front end and a rear end of each of the plurality of valves, based on an engine revolution per minute (RPM) and an ITM angle, and a controller configured to determine a state of the ITM, and adjust the opening degree of the plurality of valves depending on the differential pressure of the valve, based on the differential pressure table based on the state of the ITM. According to an exemplary embodiment, the plurality of valves may include a radiator valve, a block valve, and a heater valve. The controller may be configured to determine the state of the ITM, based on a temperature of a coolant or the engine RPM.

Additionally, the controller may be configured to determine whether maximum differential pressure of differential pressure, which is generated between a front end and a rear end of the radiator valve based on a present engine RPM and the ITM angle, and differential pressure, which is generated between a front end and a rear end of the block valve based on the present engine RPM and the ITM angle, exceeds a preset first threshold value, using a table for the differential pressure between the front end and the rear end of the radiator valve and a table for the differential pressure between the front end of the rear end of the block valve, when the state of the ITM is detemined as a state that opening control of the radiator valve and the block valve is required The controller may be configured to detect a temperature of a coolant of the ITM to detemine the state of the ITM as the state in which the opening control of the radiator valve and the block valve is required, when the temperature of the coolant is equal to or greater than a preset threshold value and when the engine RPM is less than a preset threshold value. The controller may be configured to limit outputs of the radiator valve and the block valve by a preset amount, when the maximum differential pressure exceeds the first threshold value.

The controller may further be configured to determine whether the maximum differential pressure of the differential pressure, which is generated between the front end and the rear end of the radiator valve based on the present engine RPM and the ITM angle, and the differential pressure, which is generated between the front end and the rear end of the block valve based on the present engine RPM and the ITM angle, exceeds a second threshold value greater than the first threshold value, after limiting the outputs of the radiator valve and the block valve. The controller may be configured to stop output operations of the radiator valve and the block valve, when the maximum differential pressure exceeds the second threshold value.

Further, the controller may be configured to determine whether differential pressure, which is generated between a front end and a rear end of the heater valve based on the present engine RPM and the ITM angle, exceeds a third threshold value greater than the first threshold value, by using a table for the differential pressure between the front end and the rear end of the heater valve, when the state of the ITM is determined as a state in which opening control of the heater valve is required. Accordingly, the controller may be configured to limit an output of the heater valve by a predetermined amount, when the differential pressure between the front end and the rear end of the heater valve exceeds the third threshold value.

Additionally, the controller may be configured to determine whether the differential pressure, which is generated between the front end and the rear end of the heater valve based on the present engine RPM and the ITM angle, exceeds a fourth threshold value greater than the third threshold value, after limiting the output of the heater valve.

The controller may then be configured to stop an output operation of the heater valve, when the maximum differential pressure exceeds the fourth threshold value.

According to another aspect of the present disclosure, a method for controlling an engine may include determining a state of an ITM to adjust opening of a plurality of valves as a cam rotates, determining differential pressure based on an engine RPM and an ITM angle, based on a differential pressure table previously stored based on the state of the ITM, and adjusting opening degrees of the plurality of valves depending on the differential pressure.

According to an exemplary embodiment, the determining of the state of the ITM may include detecting a temperature of a coolant of the ITM to determine the state of the ITM as a state in which opening control of a radiator valve and a block valve of the plurality of valves is required, when the temperature of the coolant is equal to or greater than a preset threshold value and when the engine RPM is less than a preset threshold value. Additionally, the determining of the state of the ITM may include detecting the temperature of the coolant of the ITM to determine the state of the ITM as a state in which opening control of a heater valve of the plurality of valves is required, when the temperature of the coolant is less than the preset threshold value.

Further, the adjusting of the opening degrees of the plurality of valves based on the differential pressure may include determining whether maximum differential pressure of differential pressure, which is generated between a front end and a rear end of the radiator valve based on a present engine RPM and an ITM angle, and differential pressure, which is generated between a front end and a rear end of the block valve based on the present engine RPM and the ITM angle, exceeds a preset first threshold value, by using a table for the differential pressure between the front end and the rear end of the radiator valve and a table for the differential pressure between the front end of the rear end of the block valve, when a state of the ITM is determined as a state in which opening control of a radiator valve and a block valve of the plurality of valves is required; and limiting outputs of the radiator valve and the block valve by a preset amount, when the maximum differential pressure exceeds the first threshold value.

The adjusting of the opening degrees of the plurality of valves based on the differential pressure may further include determining whether the maximum differential pressure of the differential pressure, which is generated between the front end and the rear end of the radiator valve based on the present engine RPM and the ITM angle, and the differential pressure, which is generated between the front end and the rear end of the block valve based on the present engine RPM and the ITM angle, exceeds a second threshold value greater than the first threshold value, after limiting the outputs of the radiator valve and the block valve, and stopping output operations of the radiator valve and the block valve, when the maximum differential pressure exceeds the second threshold value.

Further, the adjusting of the opening degrees of the plurality of valves based on the differential pressure may include determining whether differential pressure, which is generated between a front end and a rear end of a heater valve of the plurality of valves based on the present engine RPM and the ITM angle, exceeds a third threshold value greater than the first threshold value, by using a table for the differential pressure between the front end and the rear end of the heater valve, when the state of the ITM is determined as a state in which opening control of the heater valve of the plurality of valves is required; and limiting an output of the heater valve by a preset amount, when the differential pressure between the front end and the rear end of the heater valve exceeds the third threshold value, According to an exemplary embodiment, the adjusting of the opening degrees of the plurality of valves based on the differential pressure may include determining whether differential pressure, which is generated between a front end and a rear end of a heater valve of the plurality of valves based on the present engine RPM and the ITM angle, exceeds a fourth threshold value greater than the third threshold value, after limiting the output of the heater valve of the plurality of valves, and stopping an output operation of the heater valve, when the maximum differential pressure exceeds the fourth threshold value.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
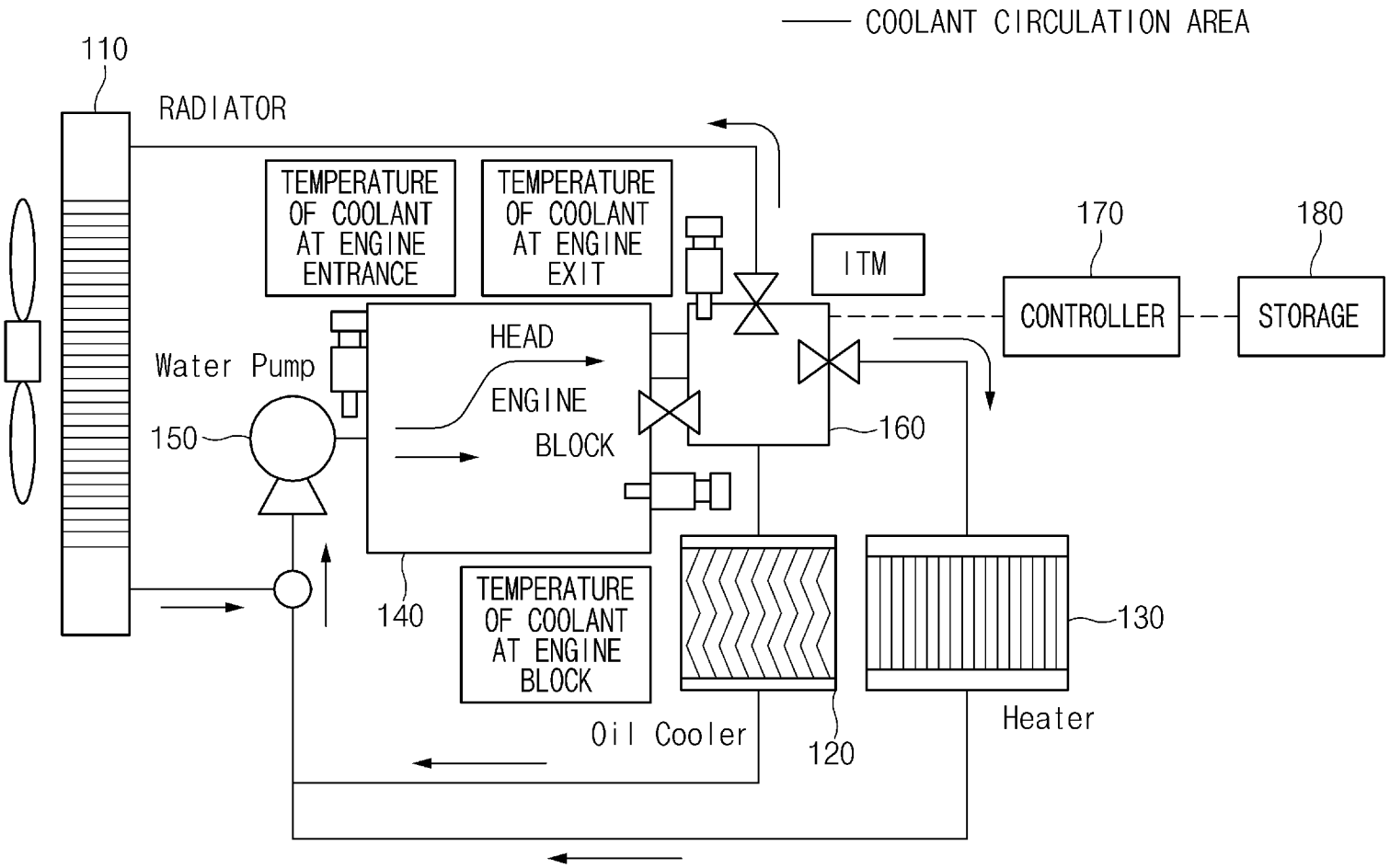
FIG. 1 is a block diagram illustrating a configuration of an apparatus for controlling an engine, according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below. Notably, the controller is specifically programmed to execute the processes described herein.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, some exemplary embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the exemplary embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the constituent components. In addition, unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined in the present application.

Hereinafter, exemplary embodiments of the present disclosure will be described with reference to FIGS. 1 and 5. FIG. 1 is a block diagram illustrating a configuration of an apparatus for controlling an engine, according to an exemplary embodiment of the present disclosure. In particular, FIG. 1 is a view schematically illustrating a configuration of a cooling system in detail, according to the present disclosure.

Referring to FIG. 1, an ITM 160, which is an apparatus for intelligently supplying a coolant depending on an engine temperature, may include a valve to control or adjust a flow rate of a coolant flowing out in a direction of a heat exchanger including a radiator, a heater core, and an oil cooler and a flow rate of a coolant flowing into a cylinder head or a cylinder block. The ITM 160 may be configured to adjust the flow rate of the coolant by adjusting a rotational angle of a cam. Hereinafter, a structure of a cam/valve of the ITM according to the present disclosure will be described with reference to FIG. 2 in detail.

To cool the engine, the coolant has to be discharged from the engine to the radiator while circulating between the radiator and the engine. In particular, the coolant discharged from the engine circulates the radiator to discharge the heat of the coolant to the air, a water pump may circulate the coolant, an oil cooler may cool an engine oil, and a heater core may discharge the heat of the coolant into a vehicle chamber, through the ITM.

The control logic of such an ITM may be configured to determine a proportional, integral, derivative (PID) gain value due to the difference between a target water temperature and a present water temperature and may set a cam angle (e.g., the opening of a valve) based on the PID gain value. In particular, a PID indicates one of automatic control manners including the combination of P (proportional), I (Integral), and D (Differential) with each other. The PID is used as an essential function for an autonomous driving vehicle, a robot, the correction of a sensor value, etc. A gain value for each of the items of the PID has to be properly set based on the type of an actuator to make a physical quantity.

Particularly, the below table 1 shows a table of angles of the ITM based on a PID gain value, in which an X axis of table 1 represents an ITM angle (RVC_AV), and a Y axis of table 1 represents an RPM (=N).

TABLE 1

| | x | | | | | | | | | | | |
|---|---|---|---|---|---|---|---|---|---|---|---|---|
| y | 0.000 | 2.000 | 3.999 | 6.000 | 8.000 | 10.001 | 12.000 | 14.000 | 16.000 | 20.000 | 30.000 | 39.000 |
| 3008 | 77.00 | 79.00 | 81.00 | 83.00 | 85.00 | 87.00 | 91.00 | 95.00 | 100.00 | 120.00 | 140.00 | 165.00 |
| 3040 | 85.00 | 85.00 | 90.00 | 90.00 | 95.00 | 100.00 | 105.00 | 110.00 | 115.00 | 120.00 | 140.00 | 165.00 |
| 3488 | 95.00 | 95.00 | 110.00 | 105.00 | 110.00 | 115.00 | 120.00 | 125.00 | 130.00 | 135.00 | 140.00 | 165.00 |
| 4000 | 115.00 | 115.00 | 115.00 | 120.00 | 120.00 | 125.00 | 125.00 | 130.00 | 130.00 | 135.00 | 140.00 | 165.00 |

As shown in table 1, the opening ITM angle may be varied based on RPMs of 3000, 3500, and 4000. For example, when the RPM of 5000 or greater meets a condition of starting to open the ITM, the excessive differential pressure of a coolant between front and rear ends of the ITM serves as resistance to apply an excessive load to the valve stem part.

Referring to FIG. 1, an apparatus for controlling an engine of a vehicle may include a radiator 110, an oil cooler 120, a heater 130, an engine 140, a water pump 150, an ITM 160, a controller 170, and a storage 180. The ITM 160 may include a plurality of valves including a radiator valve, a block valve, and a heater valve to discharge a coolant to the radiator 110, the oil cooler 120, and the heater 130, and an opening degree of the plurality of valves may be adjusted by the controller 170.

The storage 180 may be configured to store a table (e.g., differential pressure table) for the differential pressure between a front end and a rear end of each of the plurality of valves, based on an engine RPM and an ITM angle. In other words, the storage 180 may be configured to store a differential pressure table obtained through the mapping of the differential pressure between a front end and a rear end of the radiator valve based on the engine RPM and the angel of the ITM, store a differential pressure table obtained through the mapping of the differential pressure between a front end and a rear end of the block valve based on the engine RPM and the angel of the ITM, and store a differential pressure table obtained through the mapping of the differential pressure between a front end and a rear end of the heater valve based on the engine RPM and the ITM angle. Such a differential pressure table may be determined based on an experimental value and previously stored. Following table 2 shows an example of the differential pressure table obtained through the mapping of the differential pressure between the front end and the rear end of the radiator valve based on the RPM and the angel of the ITM.

TABLE 2

| | N(RPM) | | | | | |
|---|---|---|---|---|---|---|
| ITM ANGLE | 4000 | 4600 | 6000 | 5600 | 6000 | 6300 |
| 70 | 1.50 | 1.8 | 2.35 | 2.85 | 3.35 | 3.76 |
| 75 | 1.41 | 1.71 | 2.21 | 2.61 | 3.01 | 3.56 |
| 80 | 1.21 | 1.51 | 1.89 | 2.21 | 2.61 | 3.06 |
| 85 | 0.97 | 1.27 | 1.52 | 1.82 | 2.12 | 2.44 |
| 90 | 0.71 | 0.91 | 1.12 | 1.31 | 1.51 | 1.8 |
| 95 | 0.56 | 0.76 | 0.89 | 1.05 | 1.21 | 1.36 |
| 100 | 0.33 | 0.43 | 0.51 | 0.61 | 0.72 | 0.64 |
| 105 | 0.21 | 0.26 | 0.33 | 0.39 | 0.46 | 0.54 |

In addition, the storage 180 may be configured to store a table of the ITM angle based on a PID gain value for a typical PID control as shown in table 1. The controller 170 may be configured to determine the state of the ITM, determine the differential pressure of each of the plurality of valves based on the differential pressure table of the valve based on the state of the ITM, and adjust an opening degree of the valve based on the differential pressures of the valve.

The controller 170 may be configured to determine the state of the ITM based on the temperature of the coolant or the engine RPM. In particular, the state of the ITM may be classified into "Cool" and "Warm". The state of the ITM which is "Cool" may represent a valve state for decreasing the temperature of the coolant. In other words, this state represents that the radiator valve of the ITM has to be open. In this state, since the temperature of the coolant is increased, the coolant needs to flow into the radiator to cool the radiator, and the opening and closing of the radiator valve and the block valve may be repeated.

The state of the ITM which is "Warm" may represent a valve state in which the temperature of the coolant is not required to be decreased. In other words, this state represents that the radiator valve of the ITM is not required to be opened. The temperature of the coolant is lower, and thus, the coolant is not required to flow into the radiator to cool the radiator.

The controller 170 may be configured to detemine the temperature of the coolant of the ITM, and determine that the opening control of the radiator valve and the block valve is required, when the temperature of the coolant is equal to or greater than a preset threshold value (e.g., about 99° C.)) or the engine RPM is less than a preset threshold value (e.g., about 4500 RPM). To the contrary, the controller 170 may be configured to determine the temperature of the coolant of the ITM and determine that the opening control of the heater valve is required, when the temperature of the coolant of the ITM is less than the preset threshold temperature (e.g., about 99° C.).

When the state of the ITM is detemined as the state in which the opening control of the radiator valve and the block valve is required, the controller 170 may be configured to determine whether the maximum differential pressure of the differential pressure, which is generated between the front end and the rear end of the radiator valve based on a present engine RPM and an ITM angle, and the differential pressure, which is generated between the front end and the rear end of the block valve based on the present engine RPM and the ITM angle, exceeds a preset first threshold value (e.g., about 1.5 bar), by using the table for the differential pressure between the front end and the rear end of the radiator valve and the table for the differential pressure between the front end of the rear end of the block valve.

The controller 170 may be configured to limit the outputs of the radiator valve and the block valve by a preset amount (e.g., about 30% or less) when the maximum differential pressure exceeds the first threshold value. As described above, when the outputs of the radiator valve and the block valve are reduced, the decrease rate of the temperature of the coolant may be reduced, or the load applied to the valve stem part may be reduced. The controller 170 may be configured to determine whether the maximum differential pressure of the differential pressure, which is generated between the front end and the rear end of the radiator valve based on the present engine RPM and the ITM angle and the differential pressure, which is generated between the front end and the rear end of the block valve based on the present engine RPM and the ITM angle, exceeds a second threshold value (e.g., about 2.0 bar) greater than the first threshold value, after limiting the outputs of the radiator valve and the block valve.

The controller 170 may be configured to stop the output operations of the radiator valve and the block valve, when the maximum differential pressure exceeds the second threshold value. In addition, when the output operations of the radiator valve and the block valve are stopped, a light may be turned on to provide a warning regarding the temperature of the coolant, but the load applied to the valve stem part may be reduced. When the state of the ITM is determined as being a state in which the opening control of the heater valve is required, the controller 170 may be configured to determine whether the differential pressure, which is generated between the front end and the rear end of the heater valve based on the present engine RPM and an ITM angle, exceeds a third threshold value (e.g., about 2.0 bar) greater than the first threshold value, by using the table for the differential pressure between the front end and the rear end of the heater valve.

When the differential pressure between the front end and the rear end of the heater valve exceeds the third threshold value, the controller 170 may be configured to limit the output of the heater valve by a preset amount. The controller 170 may be configured to determine whether the differential pressure between the front end and the rear end of the heater valve based on the present engine RPM and the ITM angle exceeds a fourth threshold value (e.g., about 2.5 bar) greater than the third threshold value, after limiting the output of the heater valve. The controller 170 may then be configured to stop the output operation of the heater valve, when the maximum differential pressure exceeds the fourth threshold value.

Figure 2:
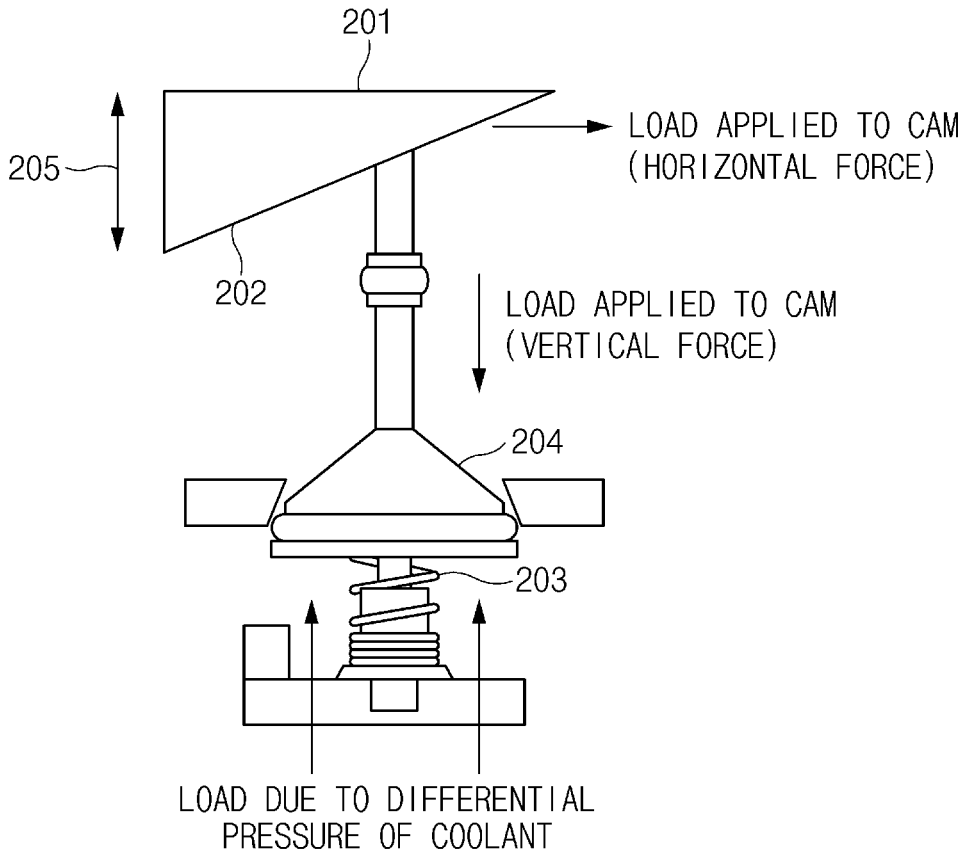
FIG. 2 is a view schematically illustrating an ITM and a cam structure, according to an exemplary embodiment of the present disclosure.

FIG. 2 is a view schematically illustrating an ITM and a cam structure, according to the present disclosure. Referring to FIG. 2, a cam 201 of the ITM interrupts the opening of a valve 204 in a direction opposite to the direction of a load applied to the cam 201 when the flow of the coolant is strong, since the coolant flows through a lower end of the valve when the cam 201 rotates at a preset angle. In other words, the cam 201 of the ITM may be configured to rotate at a preset angle to press the end of the valve 204 through an inclination surface of the cam, 201, and the spring 203 may be configured to push the valve 204 in the direction opposite to the direction that the cam 201 presses the valve 204. In particular, the valve 201 may be opened and closed due to the height difference of the cam 201, which is formed in the thickness direction of the cam 201. The cam may have a disc-shaped plate, and may have a curved "path" formed in a thickness direction of the plate of the cam, and thus, a plurality of cams may be pushed down in a vertical direction. Accordingly, as the cam rotates, a relevant valve may be pressed based on the thickness of the curved path to move up and down (e.g., vertically).

As described above, the control logic of the ITM may be performed to open the valve when the temperature of the coolant is greater than a specific temperature and to completely close the valve when the temperature of the coolant is less than the specific temperature. Particularly, when the moment that the radiator valve is closed occurs simultaneously with the moment that the RPM is increased, or when the increase rate of the RPM overwhelms a valve open time point of the ITM, the differential pressure between the front end and the rear end of the radiator valve may be rapidly increased, and thus, the excessive load may be applied to the valve stem part. Therefore, according to the present disclosure, the opening degree of the ITM, that is, a cam angle (e.g., the opening degree of the valve) may be determined using the table for the differential pressure between the front end and the rear end of each valve previously subject to the modeling based on the RPM and the ITM angle, to minimize the differential pressure between the front end and the rear end of the valve in the engine employing the ITM system.

In other words, according to the present disclosure, to prevent the excessive differential pressure between the front end and the rear end of a valve in the ITM, the mapping table of the differential pressure, which is subject to modeling, between the front end and the rear end of each valve based on the RPM and the ITM angle may be previously stored, and the differential pressure based on the RPM and the ITM angle may be identified to determine whether the differential pressure exceeds a plurality of threshold values, which are preset, to limit or stop the output of the ITM. Accordingly, novel logic may be applied according to the present disclosure to prevent a load from being excessively applied to a valve stem part of the ITM.

Figure 3:
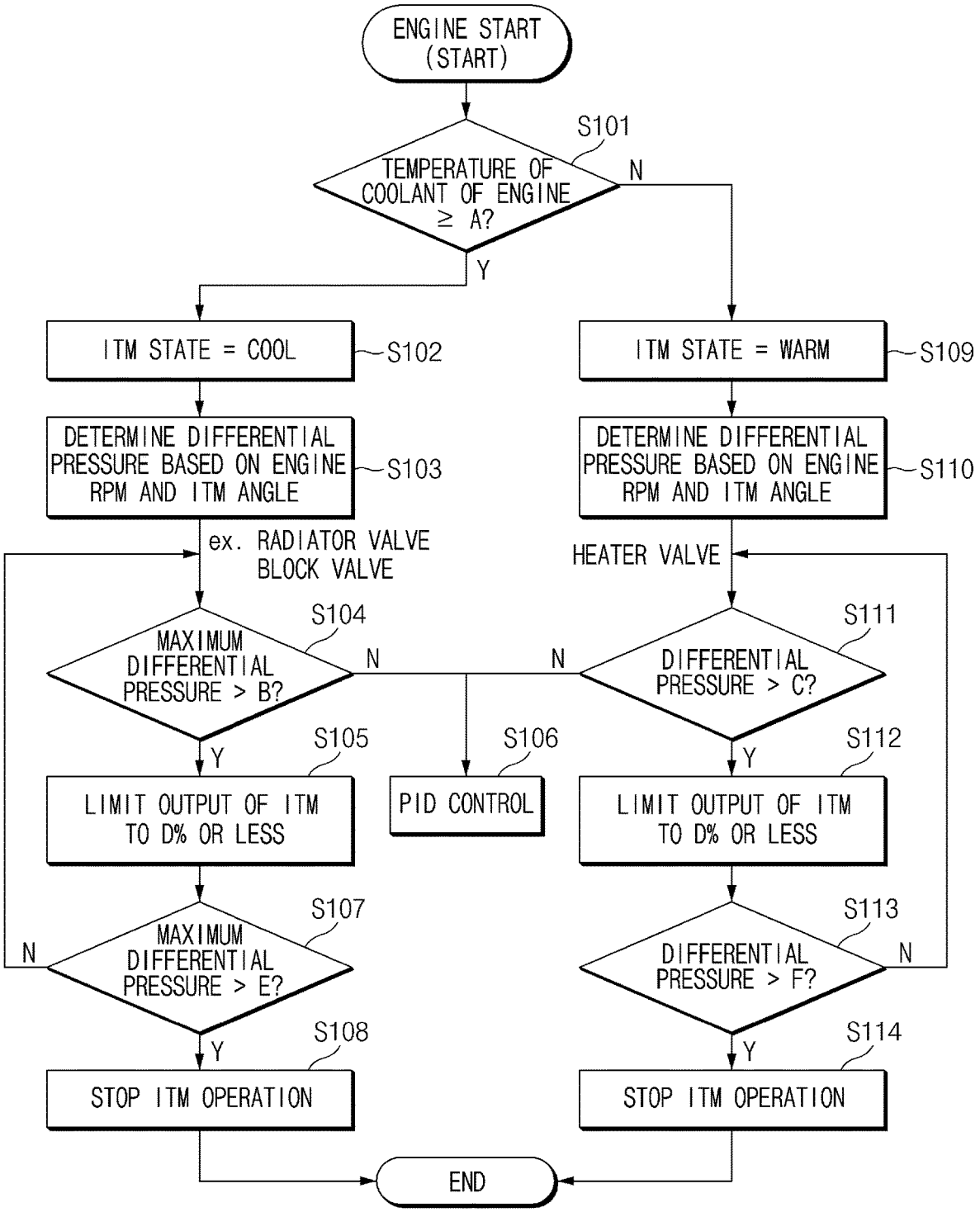
FIG. 3 is a flowchart illustrating a procedure of performing integrated flow rate control, according to an exemplary embodiment of the present disclosure.
Figure 4:
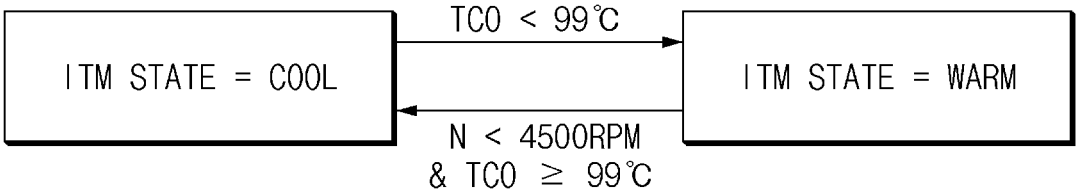
FIG. 4 is a view illustrating state transition of an ITM, according to an exemplary embodiment of the present disclosure.

Hereinafter, a method for controlling the ITM will be described in detail with reference to FIGS. 3 and 4. FIG. 3 is a flowchart illustrating a procedure of performing integrated flow control, according to an exemplary embodiment of the present disclosure, and FIG. 4 is a view illustrating state transition of an ITM, according to an exemplary embodiment of the present disclosure. Hereinafter, it may be assumed that the apparatus for controlling the engine of the vehicle of FIG. 1 operates a processor of FIG. 3. In addition, in the following description made with reference to FIG. 3, it may be understood that the operation described as being performed by the apparatus for controlling the engine may be executed by the controller 170 of the apparatus for controlling the engine of the vehicle.

Referring to FIG. 3, the apparatus for controlling or operating the engine of the vehicle may be configured to determine the temperature of the coolant of the engine after the engine starts, to determine the state of the ITM (S101). In addition, the apparatus for controlling the engine of the vehicle may be configured to determine whether the temperature of the coolant of the engine is equal to or greater than 'A' after the engine starts. As illustrated in FIG. 4, the state of the ITM may be determined using an RPM as well as the temperature of the coolant. For example, the state of the ITM may be shifted to "Warm" when the temperature (TCO) of a coolant is less than about 99° C., and may be shifted to "Cool" when the temperature of the coolant is about 99° C. or greater, and/or when the RPM is less than about 4500 RPM. In particular, when the temperature of the coolant is equal to or greater than about 99° C., and the RPM is less than about 4500 RPM, that is, when both conditions are satisfied, the state of the ITM may be set to be shifted to "Cool".

The state of the ITM may be classified into "Cool" and "Warm". When the state of the ITM is "Cool, since the temperature of the coolant in the ITM is increased, the radiator valve and the block valve may be repeatedly opened or closed to allow the coolant to flow into the radiator to cool the coolant. When the state of the ITM is "Warm", since the temperature of the coolant is decreased, the coolant may flow into the radiator to cool the radiator. Accordingly, it may be unnecessary to open the radiator valve of the ITM.

When the state of the ITM is "Cool" (S102), the apparatus for controlling the engine of the vehicle may be configured to determine the RPM and the ITM angle, and determine the differential pressure between the front end and the rear end of the radiator valve and the differential pressure between the front end and the rear end of the block valve, based on the differential pressure modeling table, which is previously stored, of the radiator valve and the block valve based on the engine RPM and the ITM angle (S103). In other words, the apparatus for controlling the engine of the vehicle may be configured to determine the differential pressure modeling table of the radiator valve and the differential pressure modeling table of the block valve to determine the differential pressure of the radiator valve and the differential pressure of the block valve as shown in Equation 1 and to determine, as the maximum differential pressure, the greater differential pressure of the differential pressure of the radiator valve and the differential pressure of the block valve.

The maximum differential pressure=Max(differential pressure of radiator valve,differential pressure of block valve). Equation 1

Accordingly, the apparatus for controlling the engine of the vehicle may be configured to determine whether the maximum differential pressure of the ITM exceeds a preset threshold value 'B' (S104), and perform typical PID control when the maximum differential pressure of the ITM is less than the preset threshold value 'B' (S106). For example, 'B' may be set to about 1.5 bar.

To the contrary, when the maximum differential pressure of the ITM exceeds the preset threshold value 'B', the apparatus for controlling the engine of the vehicle may be configured to limit the output of the ITM to be D % or less (S105). For example, 'D %' may be set to about 30%. In particular, although the operating speed of the ITM is decreased when the output of the ITM is limited, since the ITM consecutively operates, the light providing a warning regarding the temperature of the coolant may not be turned on. However, when the output of the ITM is limited, the decrease rate of the temperature of the coolant may be reduced, and the load applied to the valve stem part may be reduced.

Accordingly, the apparatus for controlling the engine of the vehicle may be configured to determine whether the maximum differential pressure of the differential pressure of the radiator valve and the differential pressure of the block valve exceeds the threshold value 'E' (S107). For example, 'E' may be set to about 2.0 bar which is greater than the threshold value 'B'. When the maximum pressure exceeds the threshold value 'E', the apparatus for controlling the engine of the vehicle may be configured to stop the operation of the ITM (S108). In particular, when the operation of the ITM is stopped, the ITM is not opened, and thus, the light may be turned on to provide a warning regarding the temperature of the coolant. However, since a motor of the ITM does not apply a load to the valve, a load may be prevented from being increased at the valve stem part or the breakage of the valve stem part may be prevented.

Meanwhile, when the temperature of the coolant is less than the threshold temperature 'A' (e.g., the temperature of the coolant is less than about 99° C.) in S101, the apparatus for controlling the engine of the vehicle may be configured to determine the state of the ITM as "Warm" (S109), determine the RPM of the engine and the ITM angle, and determine the present differential pressure of the heater valve of the ITM, based on the differential pressure modeling table based on the engine RPM and the ITM angle which are previously stored (S110). In other words, the state of the ITM is 'Warm' until the temperature of the coolant becomes about 99° C. after a driver starts a vehicle. In particular, the radiator valve and the block valve may be closed, and thus, the apparatus for controlling the engine of the vehicle may use the maximum differential pressure of the heater valve by monitoring the maximum differential pressure of the heater valve. The heater valve may have a diameter that is less than the diameter of the radiator valve, and thus, the heater valve is robust against the breakage when the load is generated due to the differential pressure. Therefore, the reference of the differential pressure for the output limit of the heater valve or the operation stop of the heater valve may be set to be greater than those of the radiator valve or the block valve.

Accordingly, the apparatus for controlling the engine of the vehicle may be configured to determine whether the differential pressure of the heater valve exceeds a preset threshold value 'C' (S111), and perform typical PID control when the differential pressure of the ITM does not exceed the preset threshold value 'C' (S106). For example, 'C' may be set to about 2.0 bar, and may be set to be greater than the threshold valve 'B' of the radiator valve and the block valve.

To the contrary, when the differential pressure of the heater valve of the ITM exceeds the preset threshold value 'C', the apparatus for controlling the engine of the vehicle may be configured to limit the output of the heater valve of the ITM to D % or less (S112). As described above, although the operating speed of the heater valve may be decreased when the output of the heater valve is limited, since the heater valve operates consecutively, the light providing the wanting regarding the temperature of the coolant may not be turned on. However, the decrease rate of the temperature of the coolant may be reduced, and the load applied to the valve stem part may be decreased.

Thereafter, the differential pressure of the heater valve may be identified again to detemine whether the differential pressure of the heater valve exceeds the threshold value 'F' (S113). For example, 'F' may be set to be about 2.5 bar, and may be set to be greater than the threshold value 'E'. When the differential pressure of the heater valve exceeds the threshold value 'E', the apparatus for controlling the engine of the vehicle may be configured to stop the operation of the heater valve (S114). As described above, when the operation of the heater valve is stopped, the light may be turned on to provide a warning regarding the temperature of the coolant, and the valve motor does not apply a load to the valve, to prevent the load from being applied to the valve stem part or to prevent the valve from being broken.

Figure 5:
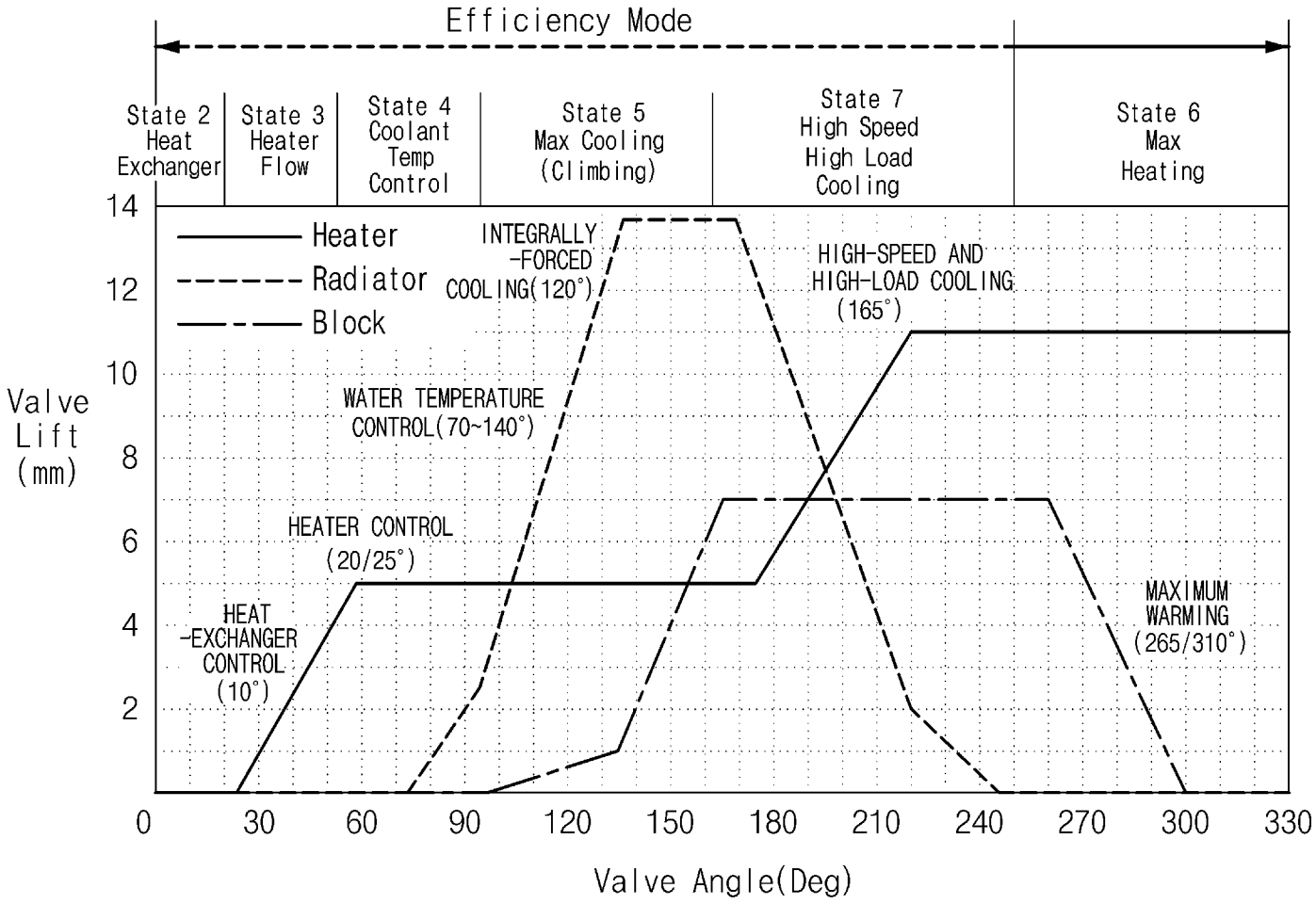
FIG. 5 is a graph illustrating a variation in an ITM angle, according to an exemplary embodiment of the present disclosure.

FIG. 5 is a graph illustrating a variation in an ITM angle, according to the present disclosure. In other words, FIG. 5 illustrates the variation of the ITM angle for each differential pressure based on the differential pressure table of each valve. As described above, according to the present disclosure, the table for the differential pressure between the front end and the rear end of the ITM based on the RPM and the ITM angle is previously stored, and the operation of the ITM may be adjusted using the differential pressure between the front end and the rear end of the ITM based on the state of the ITM after the engine starts, to prevent a load from being excessively applied to the stem part of the ITM in advance to ensure endurance.

According to the present disclosure, when the ITM is operated to be opened, the ITM may be operated to prevent the excessive differential pressure between the front end and the rear end of the ITM. In other words, the differential pressure between the front end and the rear end of the ITM may be determined using the RPM signal and a cam ITM angle, and the opening operation of the ITM may be adjusted based on the differential pressure between the front end and the rear end of the ITM, thereby preventing the load from being excessively applied to the stem part of the ITM in advance.

A variety of effects directly or indirectly understood through the disclosure may be provided. Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

Therefore, exemplary embodiments of the present disclosure are not intended to limit the technical spirit of the present disclosure, but provided only for the illustrative purpose. The scope of protection of the present disclosure should be construed by the attached claims, and all equivalents thereof should be construed as being included within the scope of the present disclosure.

What is claimed is:

1. An apparatus for controlling an engine, comprising:

an integrated thermal management (ITM) configured to adjust opening of a plurality of valves as a cam rotates;

a storage configured to store a table for differential pressure between a front end and a rear end of each of the plurality of valves, based on an engine revolution per minute (RPM) and an ITM angle; and a controller configured to determine a state of the ITM, and adjust opening degrees of the plurality of valves depending on the differential pressure of the valve, based on the differential pressure table based on the state of the ITM.

2. The apparatus of claim 1, wherein the plurality of valves include:

a radiator valve, a block valve, and a heater valve.

3. The apparatus of claim 2, wherein the controller is configured to:

determine the state of the ITM, based on a temperature of a coolant or the engine RPM.

4. The apparatus of claim 2, wherein the controller is configured to:

determine whether maximum differential pressure of differential pressure, which is generated between a front end and a rear end of the radiator valve based on a present engine RPM and the ITM angle, and differential pressure, which is generated between a front end and a rear end of the block valve based on the present engine RPM and the ITM angle, exceeds a preset first threshold value, using a table for the differential pressure between the front end and the rear end of the radiator valve and a table for the differential pressure between the front end of the rear end of the block valve, in response to determining the state of the ITM as a state in which opening control of the radiator valve and the block valve is required.

5. The apparatus of claim 4, wherein the controller is configured to:

identify a temperature of a coolant of the ITM to determine the state of the ITM as the state in which the opening control of the radiator valve and the block valve is required, in response to determining that the temperature of the coolant is equal to or greater than a preset threshold value and that the engine RPM is less than a preset threshold value.

6. The apparatus of claim 4, wherein the controller is configured to:

limit outputs of the radiator valve and the block valve by a preset amount, when the maximum differential pressure exceeds the first threshold value.

7. The apparatus of claim 4, wherein the controller is configured to:

determine whether the maximum differential pressure of the differential pressure, which is generated between the front end and the rear end of the radiator valve based on the present engine RPM and the ITM angle, and the differential pressure, which is generated between the front end and the rear end of the block valve based on the present engine RPM and the ITM angle, exceeds a second threshold value greater than the first threshold value, after limiting the outputs of the radiator valve and the block valve.

8. The apparatus of claim 7, wherein the controller is configured to:

stop output operations of the radiator valve and the block valve, when the maximum differential pressure exceeds the second threshold value.

9. The apparatus of claim 4, wherein the controller is configured to:

determine whether differential pressure, which is generated between a front end and a rear end of the heater valve based on the present engine RPM and the ITM angle, exceeds a third threshold value greater than the first threshold value, using a table for the differential pressure between the front end and the rear end of the heater valve, in response to determining that the state of the ITM is a state in which opening control of the heater valve is required.

10. The apparatus of claim 9, wherein the controller is configured to:

limit an output of the heater valve by a preset amount, in response to determining that the differential pressure between the front end and the rear end of the heater valve exceeds the third threshold value.

11. The apparatus of claim 10, wherein the controller is configured to:

determine whether the differential pressure, which is generated between the front end and the rear end of the heater valve based on the present engine RPM and the ITM angle, exceeds a fourth threshold value greater than the third threshold value, after limiting the output of the heater valve.

12. The apparatus of claim 11, wherein the controller is configured to:

stop an output operation of the heater valve, in response to determining that the maximum differential pressure exceeds the fourth threshold value.

13. A method for controlling an engine, comprising:

determining, by a controller, a state of an integrated thermal management (ITM) to adjust opening of a plurality of valves as a cam rotates;

determining, by the controller, differential pressure based on an engine revolutions per minute (RPM) and an ITM angle, based on a differential pressure table previously stored based on the state of the ITM; and adjusting, by the controller, opening degrees of the plurality of valves based on the differential pressure.

14. The method of claim 13, wherein the determining of the state of the ITM includes:

identifying, by the controller, a temperature of a coolant of the ITM to determine the state of the ITM as a state in which opening control of a radiator valve and a block valve of the plurality of valves is required, in response to determining that the temperature of the coolant is equal to or greater than a preset threshold value and that the engine RPM is less than a preset threshold value.

15. The method of claim 14, wherein the determining of the state of the ITM includes:

identifying, by the controller, the temperature of the coolant of the ITM to determine the state of the ITM as a state in which opening control of a heater valve of the plurality of valves is required, when the temperature of the coolant is less than the preset threshold value.

16. The method of claim 13, wherein the adjusting of the opening degrees of the plurality of valves based on the differential pressure includes:

determining, by the controller, whether maximum differential pressure of differential pressure, which is generated between a front end and a rear end of the radiator valve based on a present engine RPM and an ITM angle, and differential pressure, which is generated between a front end and a rear end of a block valve of the plurality of valves based on the present engine RPM and the ITM angle, exceeds a preset first threshold value, using a table for the differential pressure between a front end and a rear end of a radiator valve of the plurality of valves and a table for the differential pressure between the front end of the rear end of the block valve, in response to determining a state of the ITM as a state in which opening control of the radiator valve and the block valve of the plurality of valves is required; and limiting, by the controller, outputs of the radiator valve and the block valve by a preset amount, in response to determining that the maximum differential pressure exceeds the first threshold value.

17. The method of claim 16, wherein the adjusting of the opening degrees of the plurality of valves based on the differential pressure includes:

determining, by the controller, whether the maximum differential pressure of the differential pressure, which is generated between the front end and the rear end of the radiator valve based on the present engine RPM and the ITM angle, and the differential pressure, which is generated between the front end and the rear end of the block valve based on the present engine RPM and the ITM angle, exceeds a second threshold value greater than the first threshold value, after limiting the outputs of the radiator valve and the block valve; and stopping, by the controller, output operations of the radiator valve and the block valve, in response to determining that the maximum differential pressure exceeds the second threshold value.

18. The method of claim 16, wherein the adjusting of the opening degrees of the plurality of valves depending on the differential pressure includes:

determining, by the controller, whether differential pressure, which is generated between a front end and a rear end of a heater valve of the plurality of valves based on the present engine RPM and the ITM angle, exceeds a third threshold value greater than the first threshold value, using a table for the differential pressure between the front end and the rear end of the heater valve, in response to determining the state of the ITM as a state that opening control of the heater valve of the plurality of valves is required; and limiting, by the controller, an output of the heater valve by a preset size, in response to determining that the differential pressure between the front end and the rear end of the heater valve exceeds the third threshold value.

19. The method of claim 18, wherein the adjusting of the opening degrees of the plurality of valves depending on the differential pressure includes:

determining, by the controller, whether differential pressure, which is generated between a front end and a rear end of a heater valve of the plurality of valves based on the present engine RPM and the ITM angle, exceeds a fourth threshold value greater than the third threshold value, after limiting the output of the heater valve of the plurality of valves; and stopping, by the controller, an output operation of the heater valve, in response to determining that the maximum differential pressure exceeds the fourth threshold value.

* * * * *